United States Patent [19]

Ostermiller

[11] Patent Number: 4,917,281

[45] Date of Patent: Apr. 17, 1990

[54] DRILL HOLSTER

[76] Inventor: John S. Ostermiller, 4910 S. Gera Rd., Frankenmuth, Mich. 48734

[21] Appl. No.: 329,967

[22] Filed: Mar. 29, 1989

[51] Int. Cl.[4] ..... A45F 5/00

[52] U.S. Cl. ..... 224/253; 224/240; 224/904

[58] Field of Search ..... 224/224, 226, 227, 236, 224/238, 240–243, 246, 253, 904, 911, 912, 233

[56] References Cited

U.S. PATENT DOCUMENTS

| | | | |
|---|---|---|---|
| 2,758,798 | 8/1956 | Schmidt | 224/245 |
| 3,919,615 | 11/1975 | Niecke | 224/227 X |
| 4,307,825 | 12/1981 | Pattermann | 224/904 |
| 4,342,410 | 8/1982 | Sloan | 224/243 |
| 4,408,706 | 10/1983 | Hurley | 224/192 |
| 4,485,946 | 12/1984 | Liantaud et al. | 224/242 |
| 4,524,892 | 6/1985 | Ozeki | 224/256 |
| 4,677,362 | 6/1987 | House et al. | 320/2 |
| 4,828,154 | 5/1989 | Clifton, Jr. | 224/253 |

*Primary Examiner*—Renee S. Luebke

*Attorney, Agent, or Firm*—Jerry T. Kearns

[57] ABSTRACT

A drill holster designed for carrying rechargeable electric drills has a contoured tapering back panel terminating at an upper end in an elongated strap including a snap fastener for securement around a wearer's belt. A convexly contoured tapering front panel is secured to the back panel and forms a receptacle dimensioned to removably retain a drill. The receptacle has an open lower end through which a drill bit retained in the chuck of an electric drill may be received. A closure flap is provided for selectively closing the open lower end when desired. A plurality of pockets are provided on the holster for retaining drill bits and a loop removably retains a drill chuck key.

1 Claim, 3 Drawing Sheets

DRILL HOLSTER

BACKGROUND OF THE INVENTION

1. Field of the Invention

The present invention relates to tool carrying devices, and more particularly pertains to a holster for carrying rechargeable electric drills. Commercial builders, drY wall installers, and do-it Yourselfers frequently utilize rechargeable hand tools such as drills and screw drivers. In order to maintain these tools at hand for ready usage, the present invention provides an improved drill holster for carrying a rechargeable hand tool and accessories on the belt of an individual.

2. Description of the Prior Art

Various types of tool carrying cases are known in the prior art. A typical example of such a device is to be found in U.S. Pat. No. 2,758,798, which issued to E. Schmidt on Apr. 14, 1956. This patent discloses a tool case including a plurality of pockets for storage of assorted tools and having an upper portion provided with belt loops for receiving the belt of an individual. U.S. Pat. No. 4,408,706, which issued to T. Hurley on Oct. 11, 1983, discloses a holster adapted to hold a gun-like labeler. The holster is adapted to be connected to a belt of a user to be worn in either the left hand or right hand position. The holster includes a plurality of interconnected holster members to carry a labeler and other accessories. U.S. Pat. No. 4,485,946, which issued to J. Liautaud et al on Dec. 4, 1984, discloses a belt holder for a portable radio which includes a belt fastener and a receptacle housing. The receptacle housing is pivotally mounted to the belt fastener. A clamp mechanism includes a sliding clamp body having two projecting clamp arms which engage the radio to prevent the radio from falling from the receptacle housing. U.S. Pat. No. 4,524,892, which issued to I. Ozeki on June 25, 1985, discloses a hanger attachment for use with a knife holder having an attachment loop to be hung from an individual's belt which includes a support member having a groove and a hook member detachably mounted on the support member for removably supporting the attachment loop of the knife holder. U.S. Pat. No. 4,677,362, which issued to L. House et al on June 30, 1987, discloses a holder for storing and recharging a rechargeable electric drill. The device includes a holster that receives a portion of the drill and includes a belt engaging portion to retain the drill on the clothing of a user. The holster includes an opening exposing the electrical contacts used to recharge the tool and has a recharger base.

While the above mentioned devices are directed to tool carriers, none of these devices disclose a holster having a receptacle dimensioned to receive a rechargeable electric drill, provided with a plurality of pockets for holding accessories and including an open lower end with a closure flap for selectively covering the chuck portion of a drill. Inasmuch as the art is relatively crowded with respect to these various types of tool carriers, it can be appreciated that there is a continuing need for and interest in improvements to such devices, and in this respect, the present invention addresses this need and interest.

SUMMARY OF THE INVENTION

In view of the foregoing disadvantages inherent in the known types of tool carriers now present in the prior art, the present invention provides an improved drill holster. As such, the general purpose of the present invention, which will be described subsequently in greater detail, is to provide a new and improved drill holster which has all the advantages of the prior art tool carriers and none of the disadvantages.

To attain this, a representative embodiment of the concepts of the present invention is illustrated in the drawings and makes use of a drill holster designed for carrying rechargeable electric drills and having a contoured tapering back panel terminating at an upper end in an elongated strap including a snap fastener for securement around a wearer's belt. A convexly contoured tapering front panel is secured to the back panel and forms a receptacle dimensioned to removably retain a drill. The receptacle has an open lower end through which a drill bit retained in the chuck of an electric drill may be received. A closure flap is provided for selectively closing the open lower end when desired. A plurality of pockets are provided on the holster for retaining drill bits and a loop removably retains a drill chuck key.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constrictions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drill holster which has all the advantages of the prior art drill holsters and none of the disadvantages.

It is another object of the present invention to provide a new and improved drill holster which may be easily and efficiently manufactured and marketed.

It is a further object of the present invention to provide a new and improved drill holster which is of a durable and reliable construction.

An even further object of the present invention is to provide a new and improved drill holster which is susceptible of a low cost of manufacture with regard to both materials and labor, and which accordingly is then susceptible of low prices of sale to the consuming public, thereby making such drill holsters economically available to the buying public.

Still yet another object of the present invention is to provide a new and improved drill holster which provides in the apparatuses and methods of the prior art some of the advantages thereof, while simultaneously overcoming some of the disadvantages normally associated therewith.

Still another object of the present invention is to provide a new and improved drill holster for enabling an individual to conveniently carry a rechargeable electric drill at hand for ready usage.

Yet another object of the present invention is to provide a new and improved drill holster which includes a plurality of pockets for transporting drill bits and accessories.

Even still another object of the present invention is to provide a new and improved drill holster having an open lower end allowing insertion of an electric drill having a drill bit mounted in a chuck portion thereof and including a closure flap for selectively closing the open lower end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
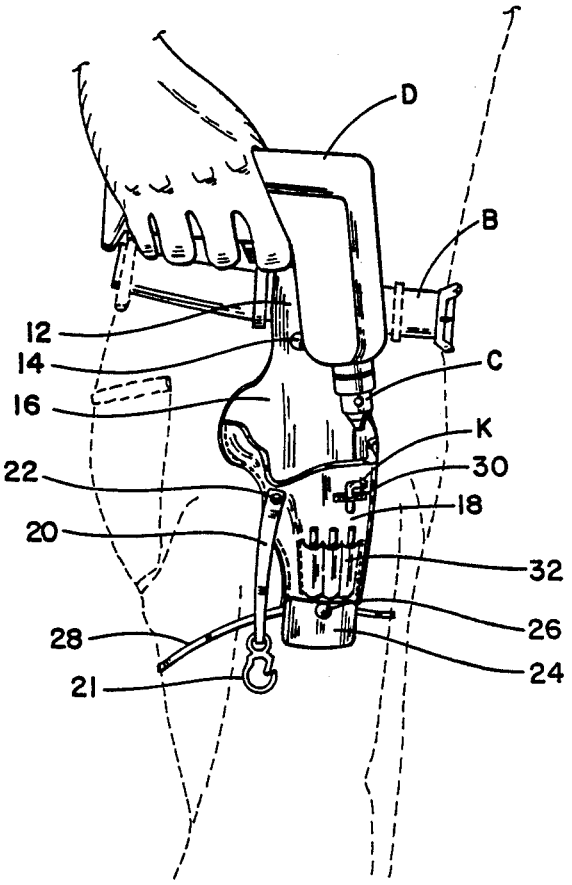
FIG. 1 is a perspective view of an individual utilizing the drill holster according to the present invention.

With reference now to the drawings, and in particular to FIG. 1 thereof, a new and improved drill holster embodying the principles and concepts of the present invention and generally designated by the reference numeral 10 will be described.

More specifically, it will be noted that the illustrated embodiment 10 of the invention includes a contoured tapering back panel 16 terminating at an upper end in an elongated strap 12 including a snap fastener 14 for securement around a belt B of a wearer. A convexly contoured tapering front panel 18 is secured to the back panel 16, forming a receptacle dimensioned to removably retain an electric drill D. The receptacle has an open lower end including a closure flap 24 with a snap fastener 26 for selectively closing the open lower end and covering the chuck portion C of the drill D. A pluralitY of pockets 32 are provided on an outer surface of the front panel 18 and are dimensioned to retain a plurality of drill bits. A loop 30 on the front panel 18 is dimensioned for removably retaining a drill chuck key K. An optional safety strap 20 for securement around a handle portion of the drill D has a first end removably secured to the front panel 18 by a snap fastener 22 and a second end provided with a snap hook 21 for engagement with an individual belt loop.

Figure 2:
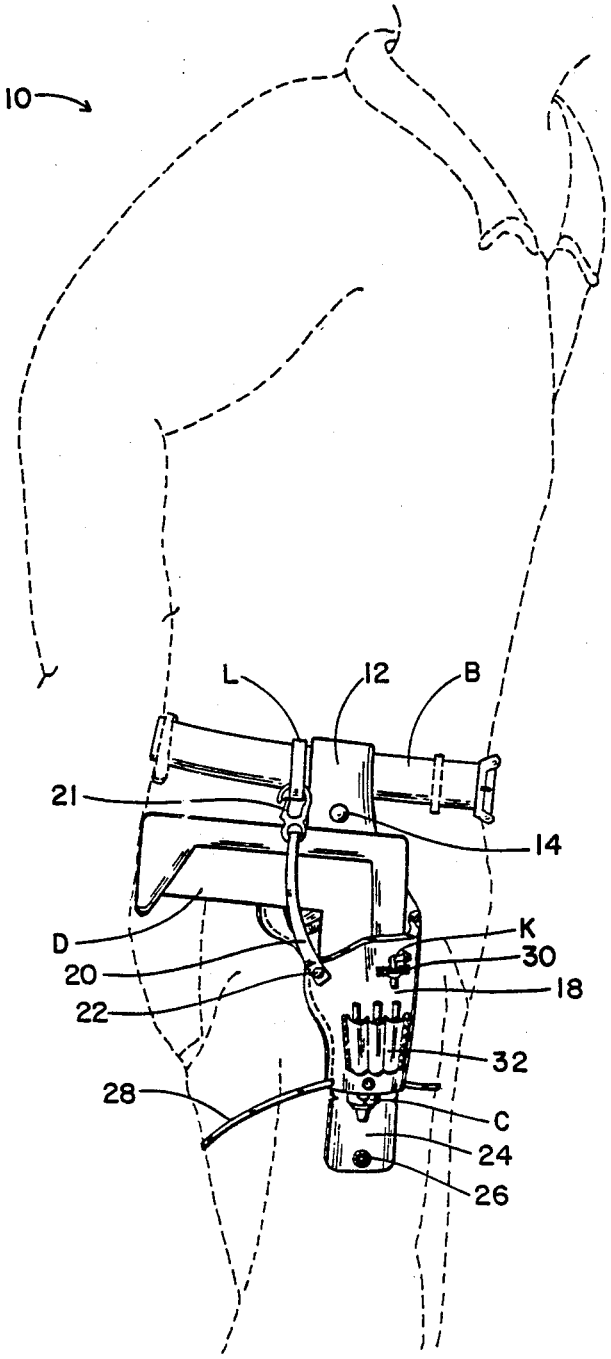
FIG. 2 is a perspective view of an individual utilizing the drill holster of the present invention to carry an electric drill when not in use.

FIG. 2 illustrates the drill holster 10 with the closure flap 24 in an open position. A tie down strap 28 may be optionally provided for securing the lower end of the holster around the upper portion of an individual's leg. This feature is useful with extremely large sized power tools, but is unnecessary for standard rechargeable drills. It is contemplated that the holster may be provided in a variety of sizes for use with differently tools. As illustrated, the safety strap 20 is received around the handle portion of the drill D and the snap hook 21 is secured to a belt loop L.

Figure 3:
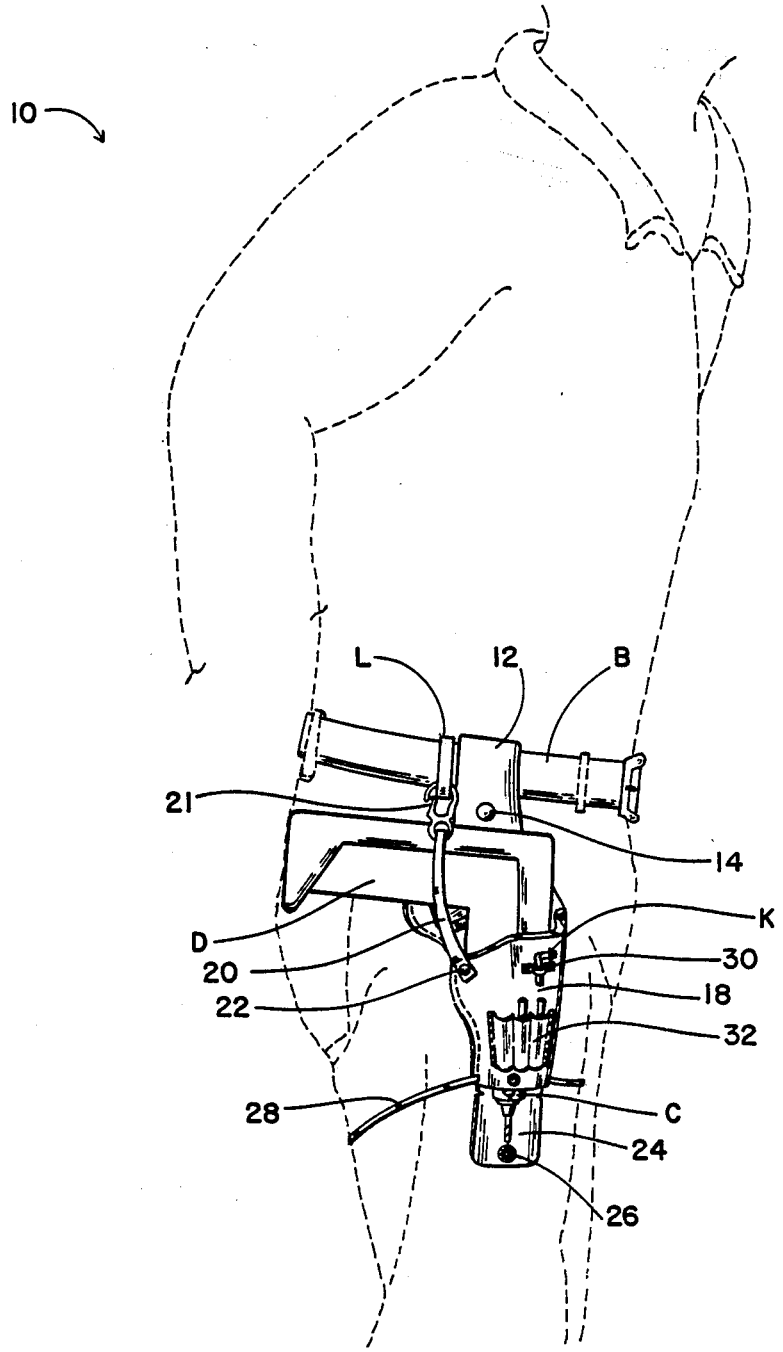
FIG. 3 is a perspective view illustrating the drill holster of the present invention utilized to carry an electric drill having a drill bit mounted in the chuck thereof.

FIG. 3 illustrates the drill holster 10 being utilized to carry a drill D with a drill bit mounted in the drill chuck C. Thus, by selectively opening the flap 24, the holster may be utilized to carry drills with drill bits mounted therein or by alternatively closing the flap 24 and engaging the snap fastener 26, the chuck portion C of the drill may be covered to prevent contamination with dust or dirt and also to protect the wearer from injury.

Figure 4:
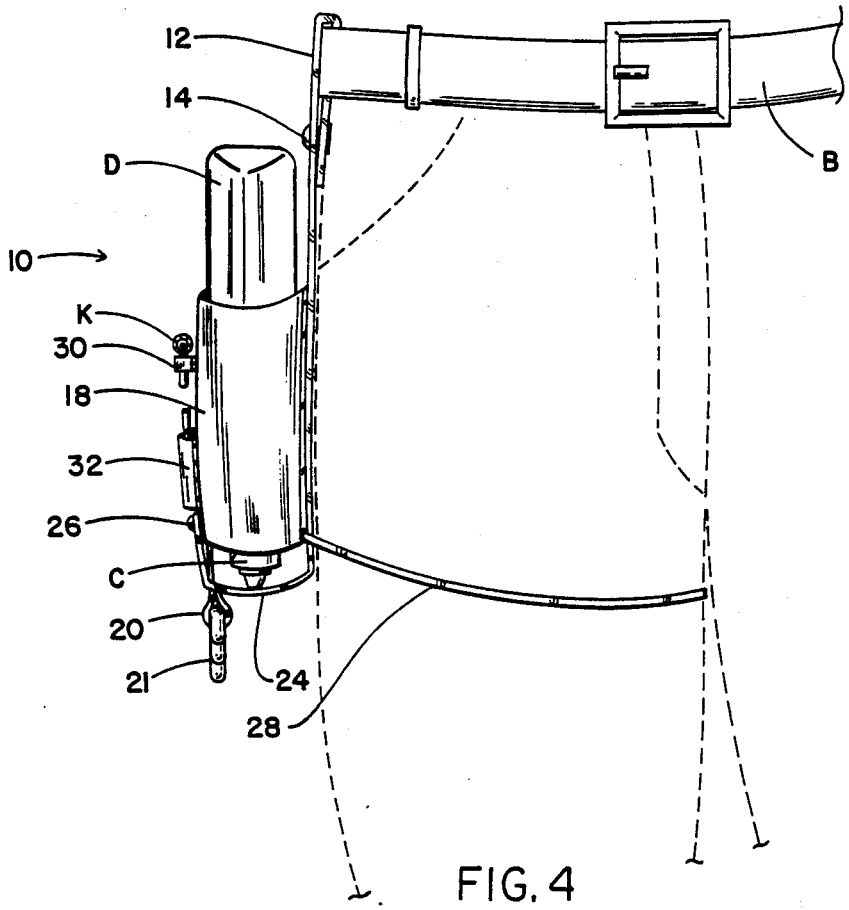
FIG. 4 is a front view illustrating the drill holster of the present invention mounted on an individual's belt.

FIG. 4 illustrates a front view of the holster 10 with the strap 12 secured by the snap fastener 14 around the belt B of a wearer.

Figure 5:
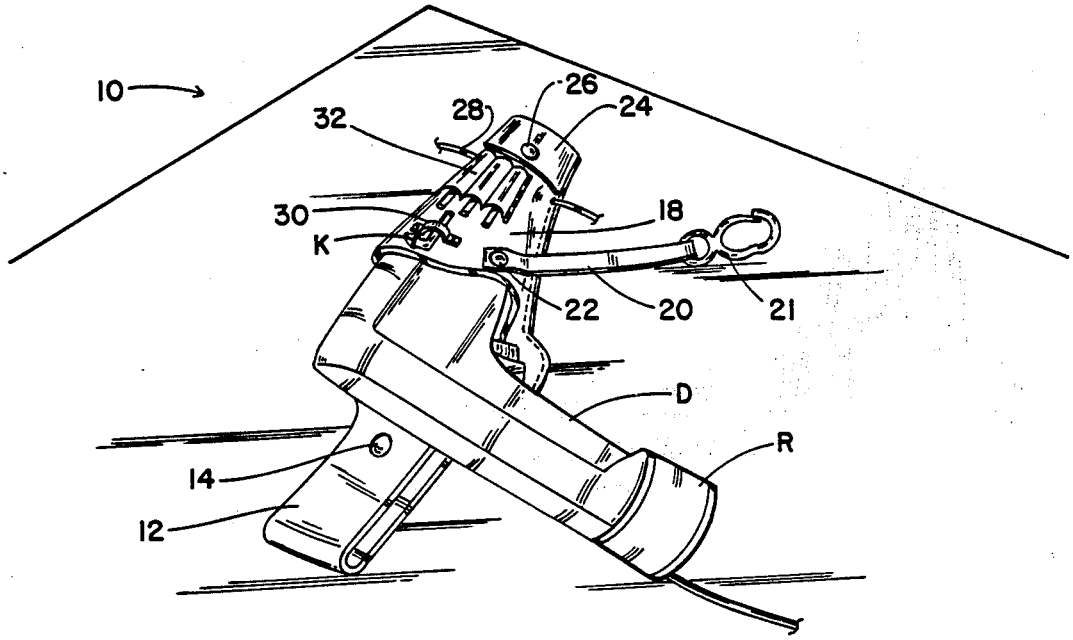
FIG. 5 is a perspective view illustrating an electric drill received in the drill holster of the present invention during a recharging operation.

FIG. 5 illustrates the drill holster 10 being utilized to store the drill D during a recharging operation. A recharging unit R is connected to conventional electrical contacts provided in the handle of the drill D.

As may now be understood, the present invention provides a drill holster which enables an individual to conveniently transport a rechargeable power tool and accessories.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A drill holster, comprising:

a contoured tapering back panel terminating at an upper end in an elongated strap including first fastening means for securement around a wearer's belt;

a convexly contoured tapering front panel secured to said back panel, forming a receptacle dimensioned to removably retain an electric drill;

said receptacle having an open lower end including a closure flap for selectively closing said open lower end;

said closure flap formed by a continuation of said back panel;

second fastening means for retaining said closure flap in a closed position in which said closure flap extends in spaced parallel overlying relation with respect to said back panel, and allowing opening of said closure flap to a position in which said closure flap extends in a common plane with said back panel, and allowing insertion of an electric drill including a chuck mounting an elongated drill bit;

a plurality of pockets provided on an outer surface of said front panel and dimensioned to retain a plurality of drill bits;

a loop on said front panel for retaining a drill chuck key; and a safety strip for securement around a handle portion of a drill received in a said receptacle, said safety strap having a first end removably secured to said front panel and a second end provided with a hook for engagement with a wearer's belt loop.

* * * * *